US006360906B1

(12) United States Patent
Kaufhold et al.

(10) Patent No.: US 6,360,906 B1
(45) Date of Patent: Mar. 26, 2002

(54) SLACKLESS RAILWAY COUPLER WITH BUFF/DRAFT GEAR

(75) Inventors: Horst T. Kaufhold; John J. Steffen, both of Aurora, IL (US)

(73) Assignee: Amsted Industries Incorporated, Chicago, IL (US)

( * ) Notice: Subject to any disclaimer, the term of this patent is extended or adjusted under 35 U.S.C. 154(b) by 0 days.

(21) Appl. No.: 09/620,983

(22) Filed: Jul. 21, 2000

(51) Int. Cl.[7] ..... B61G 1/00
(52) U.S. Cl. ..... 213/75 R; 213/32 C
(58) Field of Search ..... 213/75 R, 220, 213/7, 32 C, 40 R, 62 R, 64

(56) References Cited

U.S. PATENT DOCUMENTS

| | | | | |
|---|---|---|---|---|
| 2,318,472 A | | 5/1943 | Dwyer, Jr. et al. | |
| 2,880,888 A | | 4/1959 | Blattner | |
| 3,227,288 A | | 1/1966 | Mulcahy et al. | |
| 3,716,146 A | | 2/1973 | Altherr | |
| 4,258,628 A | | 3/1981 | Altherr | |
| 4,336,758 A | | 6/1982 | Radwill | |
| 4,456,133 A | | 6/1984 | Altherr et al. | |
| 4,531,648 A | | 7/1985 | Paton | |
| 4,593,827 A | | 6/1986 | Altherr | |
| 4,593,829 A | | 6/1986 | Altherr | |
| 4,700,853 A | | 10/1987 | Altherr et al. | |
| 5,131,548 A | | 7/1992 | Chi | |
| 5,312,007 A | * | 5/1994 | Kaufhold et al. | 213/75 R |
| 5,360,124 A | * | 11/1994 | Wurzer et al. | 213/62 R |
| 5,598,937 A | * | 2/1997 | Clark | 213/45 |

FOREIGN PATENT DOCUMENTS

CA 1258258 8/1989

OTHER PUBLICATIONS

Draft Gears and Cushion Underframes, *Car and Locomotive Cyclopedia Centennial Edition* 1974, pp. S9–1 through S9–42.

Couplers & Yokes, etc., American Steel Foundries Sales Brochure, AMSTED Industries Incorporated.

* cited by examiner

*Primary Examiner*—S. Joseph Morano
*Assistant Examiner*—Robert J. McCarry, Jr.
(74) *Attorney, Agent, or Firm*—Edward J. Brosius

(57) ABSTRACT

A pocket-casting is provided for a railcar slackless coupler having a draft gear subassembly for preloading the coupler assembly in the buff and draft directions, which pocket-casting and cooperating positive stops in a center-sill of a railcar limit the longitudinal travel and consequent loading of the slackless coupler in both the buff and draft directions for transfer of the forces to the plate-reinforced center sill to ease the shock loading on the coupler assembly.

9 Claims, 5 Drawing Sheets

SLACKLESS RAILWAY COUPLER WITH BUFF/DRAFT GEAR

BACKGROUND OF THE INVENTION

The present invention provides a railway car coupler or connector with a buff/draft gear assembly. More particularly, the invention relates to a slackless drawbar connector with an integral assembly to cushion the dynamic loading of the slackless connector in the buff and draft directions of the coupled railcars.

The rail industry developed with the steam locomotive, which is a lower torque drive means than the modern diesel locomotive. The steam locomotive did not have the torque capacity to initiate drive on the full length of a train of tightly coupled cars, therefore, a degree of free-travel or free-play between-cars was required to allow sequential initiation of car travel of loaded trains. The coupling apparatus between the cars had to accommodate the longitudinal travel in both directions, and also handled the vertical and horizontal travel at the coupling as the train progressed along the rails. In addition, couplers are generally assembled from as-cast components, which do not have the dimensional tolerances associated with machined elements. Therefore, all the free play and relatively loose connections associated with earlier couplers were acceptable conditions, and as noted above, they were necessary conditions.

The diesel locomotive brought changes in the load-bearing capacity of trains, their physical parameters and their operating characteristics. The physical and mechanical properties of the couplers joining the individual cars of the train also changed to accommodate the train improvements. The greater loads carried by modern railway trains have changed the perception of the coupler engineer and designer with regard to train operating characteristics. Indicative of this change in perception is that heavier loads are carried on rail cars and the industry has moved to maintain close-butted relationships between coupler draft components to lessen the impact forces on cars, couplers and lading.

Since most coupler drawbar connection parts are as-cast pieces with little or no finish machining to provide dimensional control, it is desirable to provide a self-adjusting coupling device to accommodate component wear and to lessen the slack in the coupler connections. One type of self-adjusting articulated coupler is shown in U.S. Pat. No. 3,716,146.

In an exemplary slackless drawbar coupling structure, the drawbar extends between the car sill sides and nests in a pocket casting. The butt end of the drawbar may be convexly arcuate and abut a complementary front concave surface of a follower block. The back surface of the follower abuts the front surface of a wedge, which has a rear surface abutting the rear wall of the pocket casting within the car sill. Either or both of the front and rear surfaces of the wedge member diverge upwardly to yield a gravity-assisted wedging force, which provides the slackless coupling arrangement. When the abutting surfaces become worn, the wedge member drops slightly to maintain the essentially slackless connection.

The top, bottom and vertically disposed side walls in the pocket casting of the drawbar coupling arrangement provide a cavity for the follower and the wedge. Upon horizontal angling of the drawbar, the side walls limit the lateral translation and, therefore, the rotation of the follower about the vertical axis of the arcuate butt end of the drawbar. Rotation of the follower may potentially cause the wedge to rotate about the car longitudinal axis and possibly hang up between the vertical walls, especially when the wedge is small in height relative to its width. A method of controlling rotation of the follower, and the relative orientation with the wedge, provides for a very close tolerance between the vertical side walls of the cavity and the follower side edges. As these are cast components, the procedure providing close tolerances between components requires an uneconomical amount of tolerance design and machining of finished parts.

The term slackless means that the drawbar, or coupler, is received within the center sill in a manner to minimize longitudinal play or movement. As successive railway cars in a train must accommodate relative movement between cars when curves and inclines are negotiated, there must be a provision for each car to move in pitch, yaw and roll modes with respect to the coupler member. Moreover, there must also be a provision to remove the draft components for repair and replacement of parts and, to disconnect coupled cars.

In a slackless system, the coupler member is held in a manner to eliminate, or minimize, longitudinal movement with respect to the car body. As noted above, this may be done by providing a tapered wedge between a rear wall of a pocket casting secured in the center sill and a follower block, which rests against the butt end of the coupler member shank. The wedge tends to force the follower block away from the pocket casting end wall and firmly against the butt end of the coupler member shank. In railway cars being pushed, the longitudinal forces cause compression of the coupler member against the follower, wedge and pocket end wall of the slackless arrangement.

When railcars are being pulled, a draft key or connecting pin acts against the longitudinal forces tending to separate the drawbar from the pocket casting. The pin or draft key is a metal bar extending laterally or vertically through the center sill and a slot or pin bore in the shank of the coupler member. In a slackless drawbar system, the drawbar is held tightly against the connecting pin or draft key by the action of the wedge separating the pocket casting from the follower block. The wedge compresses the follower block against the butt end of the drawbar, which biases the drawbar at the pin bore or slot against the pin or key. However, the mating faces of the follower block and drawbar are preferably curved to allow the drawbar to pivot, both vertically and laterally, and to permit the car to roll with respect to the drawbar. The drawbar may also pivot at the draft key or pin connection on an arcuate pin or key bearing-block interposed between the parts.

In U.S. Pat. No. 4,593,827 to Altherr, a slackless coupler is shown with the drawbar extending into the car center sill. The front surface of a follower block in the center sill has an arcuate concave section abutting the convex arcuate end of the drawbar. The follower block rear surface has a convex shape of two generally planar surfaces joined at a vertex substantially in the vertical center plane of the railcar. The wedge shim is provided with a generally concave surface, which complementarily abuts the convex surface of the follower block. The interrelationship of the shim and block surfaces maintains the orientation of the assembly and inhibits lateral translation between the shim, the follower and the side casting.

U.S. Pat. No. 4,700,853 to Altherr et al. also provides a slackless coupler with the placement of contoured spacer means within the center sill on either side of the coupler member, both above and below the draft key slots, to prevent lateral movement of the drawbar on the draft key. A preferred embodiment also includes access means or ports in the pocket casting for engagement or withdrawal of the wedge from contact with the follower blocks.

Draft gear assemblies have been known and utilized for coupler systems in the prior art, however, they frequently utilized large spring assemblies, which added to the weight of the undercarriage assembly and detracted from the freight carrying capacity of the railway car. Illustrative examples of draft gear assemblies operable to absorb buff and draft forces applied to the draft gear are shown in CAR AND LOCOMOTIVE CYCLOPEDIA, CENTENNIAL EDITION (1974), at page S9–S32. Force diagrams, which illustrate the effect of impact forces on a cushioning device from both directions along the longitudinal axis of the assembly, are noted in some of the figures. The intent of most known draft gear assemblies is generally to protect the freight car structure. Lading protection, however, requires varying degrees of energy dissipation. Sliding sill arrangements to accommodate lading protection are generally complicated assemblies with attendant higher assembly costs. Therefore, end-of-car cushioning devices evolved, which units could be installed outboard of the car bolsters but they do not fit within the standard draft gear pockets. These cushioning units have both greater travel and greater energy absorbing ability than conventional draft gears. The American Association of Railroads, A.A.R., specifications for Special Cushioning Devices for Freight Cars are delineated at A.A.R. specification number M-921-65, and include impact testing, as well as appraisal under actual service conditions and service experience.

Buff gears or buff gear assemblies are also known and utilized in railroad car couplers to form a compression spring assembly. These buff or draft gear assemblies are typically used between railway cars to buffer the impact of adjacent cars, and to compensate for the impact loads on the car couplers during operation of the train. A buff gear arrangement is illustrated in U.S. Pat. No. 4,556,678 to D. G. Anderson and includes a mounting assembly for positioning the cushioning apparatus in the coupler assembly. The buffer operates to absorb the force load from the impact between adjacent cars in a freight train, which impacts may occur during humping of freight cars. However, the utilization of these buff-draft gear assemblies has not been feasible with slackless couplers, as these couplers had to be operable in both the draft and buff directions with little or no longitudinal free play in the coupler assembly.

SUMMARY OF THE INVENTION

The present invention provides a shock-absorbing, dynamically-loaded, buff/draft gear apparatus to absorb the load on a slackless railroad car coupler in both the buff and draft directions of travel. The buff/draft gear structure avoids the shock-loading of the coupler assembly from sudden acceleration in the draft direction and retains the shock-absorbing capability of the assembly in the buff direction, especially for freight cars being humped. This buff/draft gear apparatus is operable with slackfree couplers, which are not the articulated type of connectors, without dramatic changes in the center sill or other mechanical structure of the coupler and drawbar assemblies. The buff/draft gear structure is not prohibitively large, which minimizes its space requirements, and it is also adaptable to existing railroad car center sills with draft gear assemblies. The buff/draft gear structure makes the utilization of extant slackless subassemblies adaptable for incorporation into the shock-absorbing apparatus, and provides a variable load-absorbing apparatus for each particular railroad car and coupler, which load-absorbing apparatus is based upon design criteria. This latter variation in shock-absorbing capacity is accommodated by the addition of more or fewer of the axially arranged friction pads in the load-absorbing elements.

The slackless coupler and the buff/draft gear assembly have individually been provided in couplers. However, slackless couplers have less free travel to accommodate the draft-direction coupler loading. Short-travel shock-loads in the draft direction can generate knuckle or coupler wear and damage in a slackless coupler. This concern is alleviated by the present invention as the load is transferred from the connecting pin and pocket-casting to front-stops and eventually to the sidewalls of the side sill. The pocket-casting and front-stops also permit the buff/draft gear to absorb the compressive load in the buff direction over a cushioned-load range and thereafter, the additional buff loading is accommodated through the front stops, and the side sill.

BRIEF DESCRIPTION OF THE DRAWING

In the figures of the drawing like reference numerals identify like components, and in the drawings

DETAILED DESCRIPTION OF THE INVENTION

Figures 1, 2:
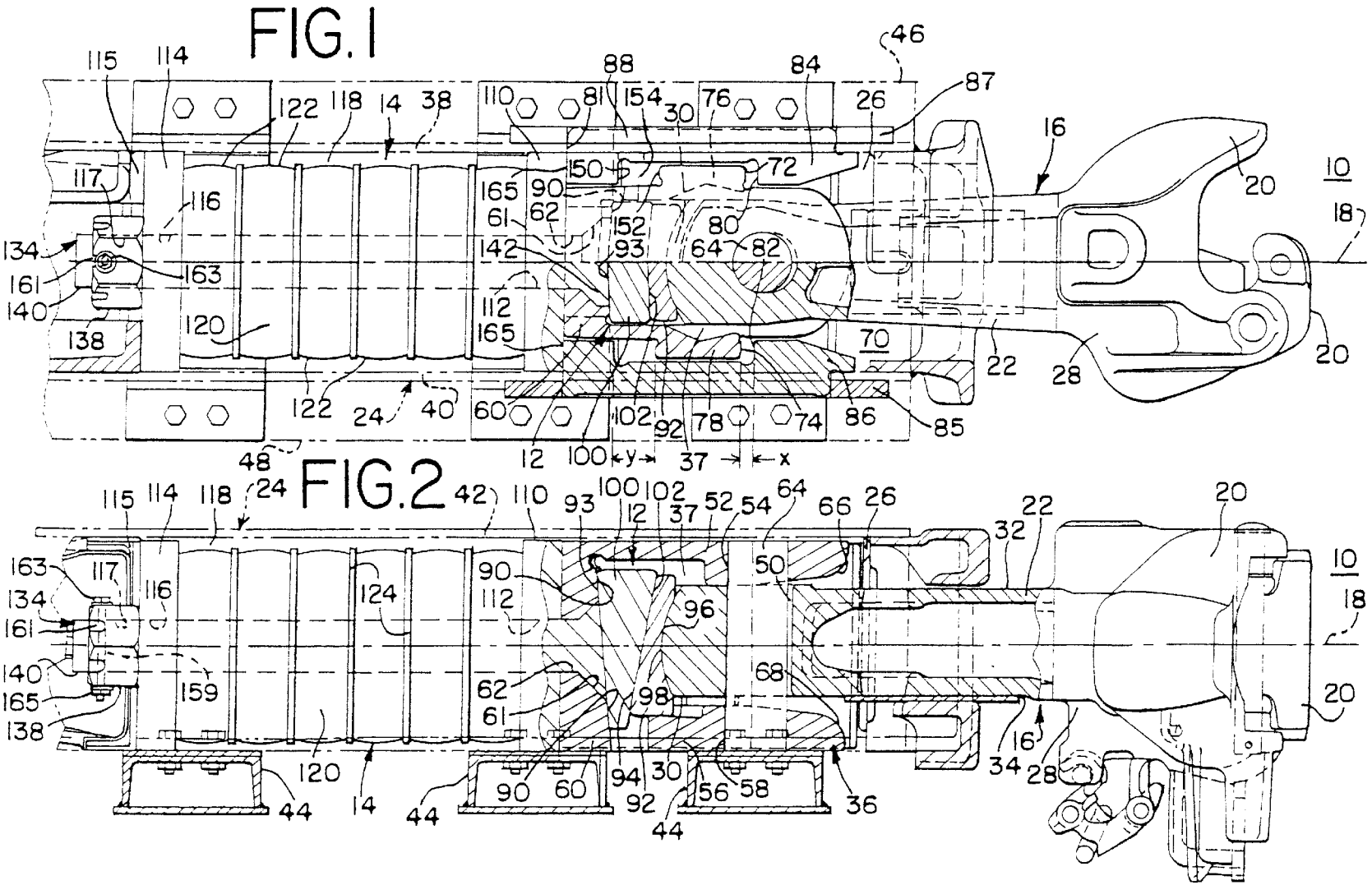
FIG. 1 is a plan view of the slackfree coupler and buff/draft gear assembly in partial cross-section.
FIG. 2 is an elevational view in cross-section of the slackfree coupler and buff/draft gear assembly of FIG. 1.

Railway car standard coupler assembly 10 in FIGS. 1 and 2 has slackfree apparatus 12 with wedge 100 and follower 92 to minimize free play in coupler assembly 10, and buff/draft gear apparatus 14 to accommodate dynamic shock loading of coupler 16 in both the buff and draft directions of travel along coupler-arm longitudinal axis 18. Coupler shank 22 extends along axis 18 connecting coupler head 20 into pocket 26 of center sill 24. Coupler head 20 is matable with a similar or mating member protruding from a second railway car or locomotive to connect the cars for travel along railway tracks, which railway cars and tracks are not shown, but are known in the art.

Slackfree coupler apparatus 12 minimizes the free travel of coupler 16 in the draft direction of railway travel through automatic adjustment of apparatus 12. More specifically, coupler shank 22 has forward end 28 connected to coupler head 20, and a rear or butt end 30, which has an arcuate shape in the horizontal direction. Upper surface 32 and lower surface 34 of shank 22 are generally planar, however, their shape is not a limitation to the present invention. Coupler shank 22, and particularly butt end 30, extend into pocket casting 36 mounted in center sill pocket 26.

Center sill 24 has first sidewall 38, second sidewall 40 and top wall 42 in FIG. 2, which cooperate to provide center-sill pocket 26. Supports 44 extend across lower edges 46 and 48 of first and second sidewalls 38 and 40 to provide an essentially closed pocket 26 in center sill 24 to receive draft/buff gear apparatus 14 and coupler shank 22.

In FIGS. 1 and 2, coupler shank 22 in proximity to butt end 30 has a vertical connecting-pin bore 50, which is transverse to axis 18 in the figures and about normal to upper surface 32 and lower surface 34. Pocket casting 36 is connected to buff/draft gear apparatus 14 and shank 22 to provide a moving or sliding connection between these components. In FIGS. 1 to 4, pocket casting 36 includes chamber 37 and, it has upper wall 52 with first passage 54 and lower wall 56 with second passage 58, which passages 54 and 58 are aligned. Rear wall 60 of pocket-casting 36 has an aperture 62 generally centrally aligned with axis 18. Pocket casting 36 is positioned and can slide in center-sill pocket 26 to receive the rear portion 30 of shank 22 in pocket-casting chamber 37. Passages 54 and 58 are alignable with pin bore 50 for receipt of vertical connecting pin 64, and connection of coupler 16 with center sill 24 for rotation or pivoting of shank 22 about pin 64. Further, upper wall 52 and lower wall 56 have inner wall surfaces 66, 68, respectively, which surfaces slope or are essentially outwardly tapered from passages 54, 58 toward open end 70 of center sill 24.

Pocket casting 36 in the illustrated reference position of FIGS. 1 and 2 can slide in cavity 26 along axis 18. However, travel of casting 36 in the draft direction is limited by contact between front surfaces 72 and 74 of pocket-casting front-plates 76 and 78, respectively, with stop-surfaces 80, 82 of respective front-stops 84, 86. Front-stops 84, 86 with stop-surfaces 80, 82, respectively, limit the forward or draft motion of casting 36 and they simultaneously act as parallel sliding guides for pocket casting 36.

Figure 2A:
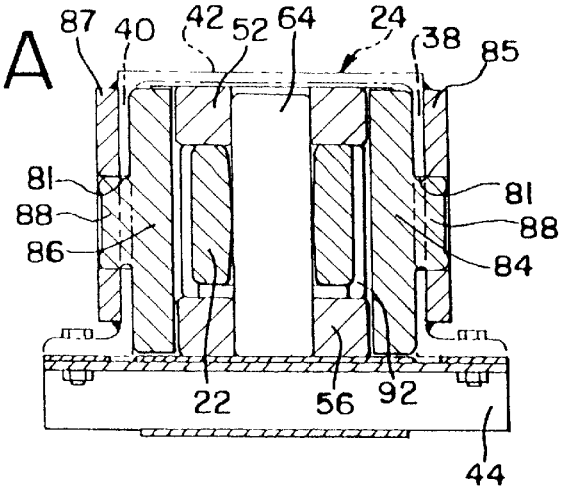
FIG. 2A is a cross-sectional end view taken along the line 2A—2A in FIG. 2.
Figure 5:
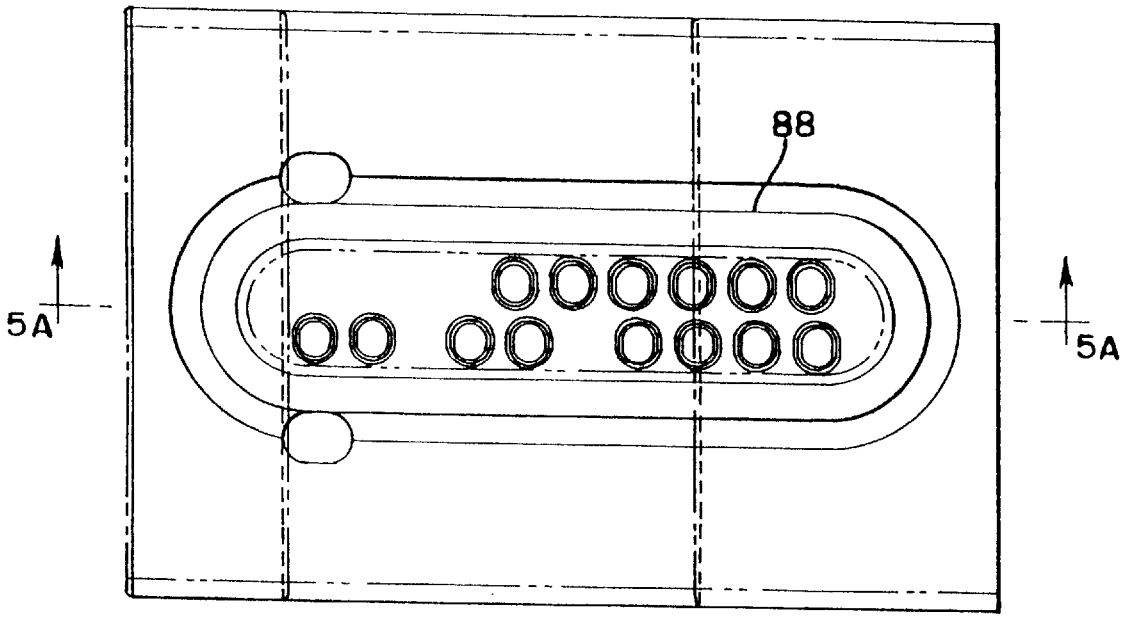
FIG. 5 is an elevational view of the front-stop and buff lug of FIG. 1.
Figure 5A:
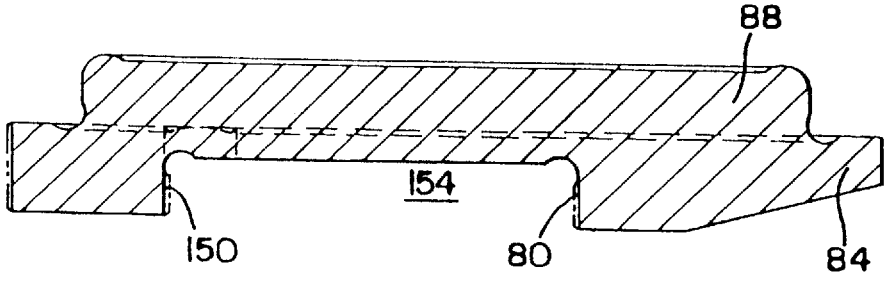
FIG. 5A is a cross-sectional plan view of the front-stop in FIG. 5 taken along the line 5—5.
Figure 6:
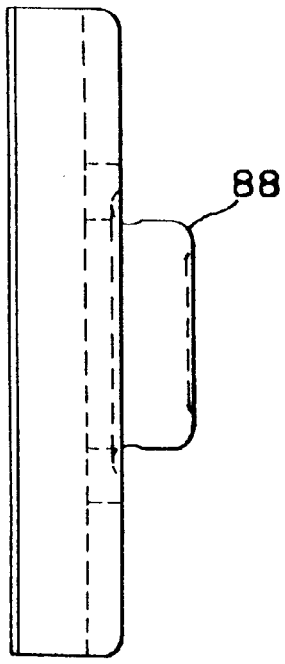
FIG. 6 is an elevational view of the front-stops in FIG. 5.
Figure 6A:
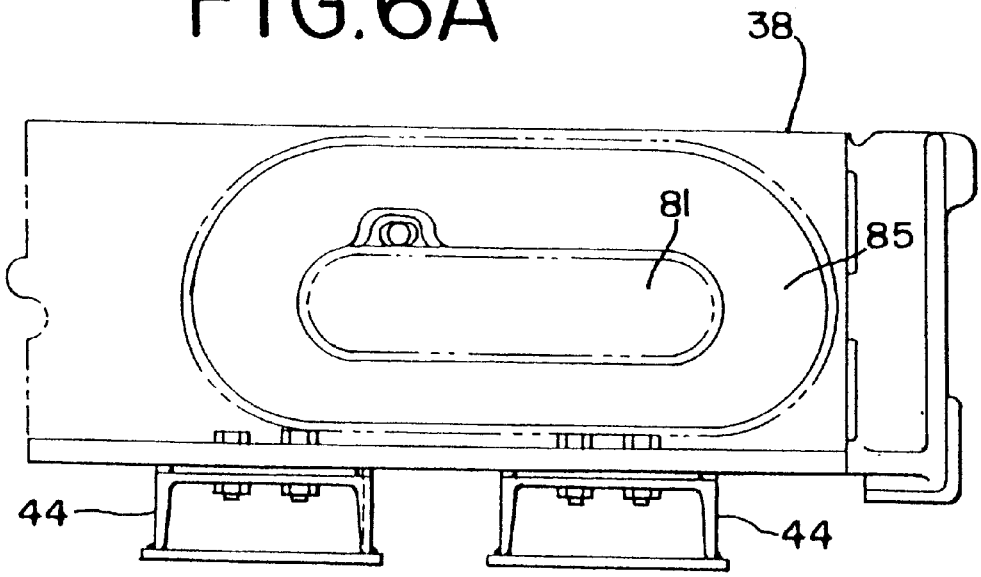
FIG. 6A is an elevational view of a front-stop mounting slot in the side sill.
Figure 7:
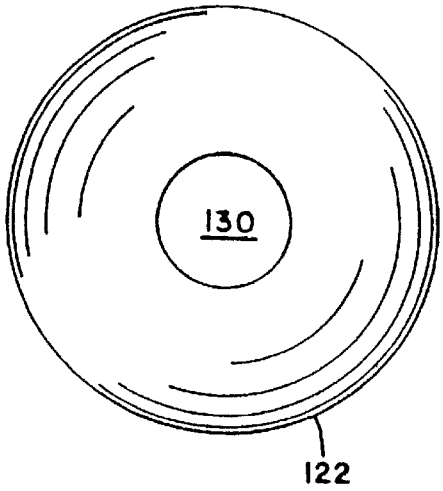
FIG. 7 is a plan view of an annular-shaped elastomer body or pad for use as a load-absorbing element in a buff gear assembly.

Front-stops 84, 86 are secured in position relative to walls 38 and 40 within center-sill cavity 26. More specifically, side sills 38 and 40 each have a mounting slot 81, which slots 81 are shown in FIGS. 2A and 6A. Slot 81 is noted in FIG. 1 in side sill 38, and at assembly receives buff lug 88 of FIGS. 1, 2A, 5 and 5A to secure front-stop 84. It is recognized that a similar subassembly exists in side sill 40 for front-stop 86. In FIGS. 5, 5A and 6, buff lug 88 and front stop 84 are noted as a single assembly or unit, which may be a single forging, welded elements or unitary cast structure for example. As noted, front-stop 84 generally extends across the height of pocket-casting chamber 37 to provide maximum load distribution from encounters between front stop surface 80 and pocket-casting front surface 72. Front-stops 84 and 86 are contoured and shaped to minimize their weight, while maintaining operability and adequate mechanical strength for the application. Sill reinforcement plates 85 and 87, each with an opening formed to receive lug 88, are connected to sill sidewalls 38 and 40, respectively, to increase the draft/buff gear load bearing area. Plates 85 and 87 may be secured to sidewalls 38, 40 by means known in the art, such as welding.

Figure 3:
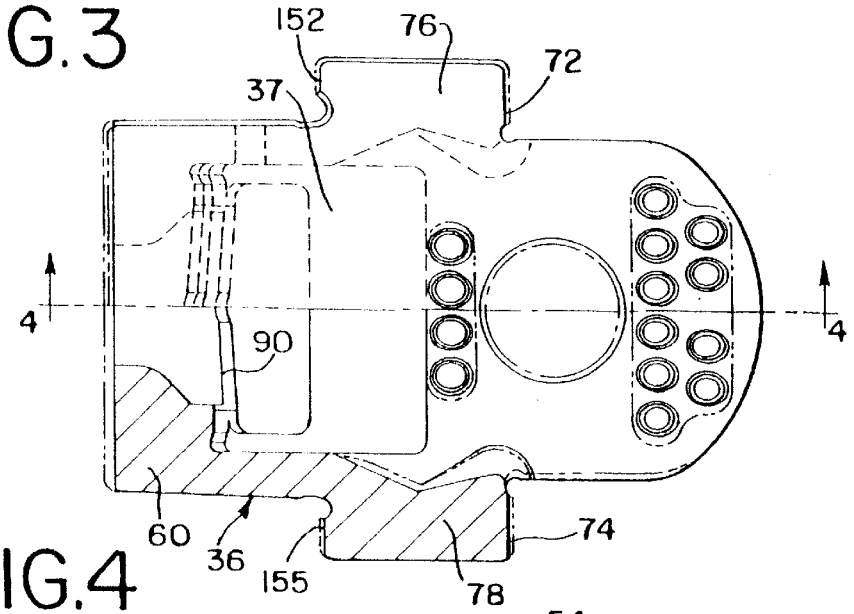
FIG. 3 is a plan view of an integral pocket casting in partial cross-section.
Figure 4:
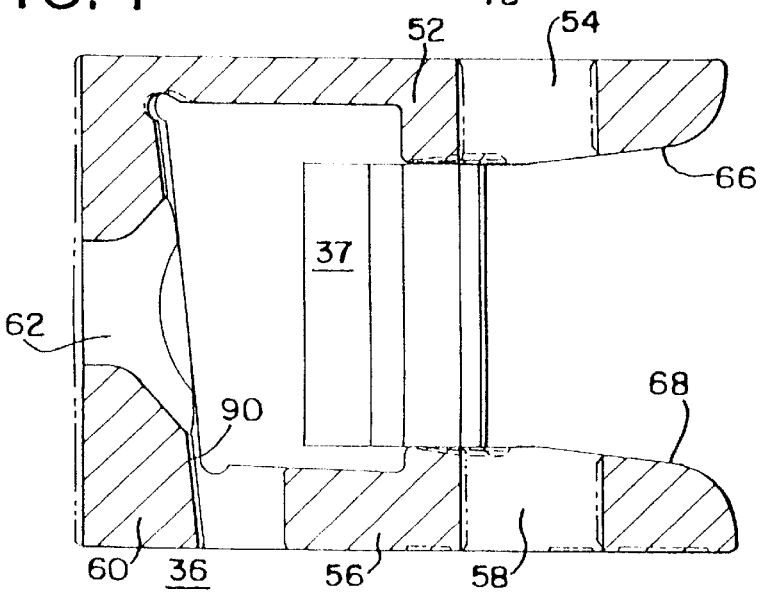
FIG. 4 is an elevational view of the pocket casting of FIG. 3 in cross-section taken along the line 4—4.

Pocket-casting rear wall 60 in FIGS. 3 and 4 has forward surface 90 tapered from upper wall 52 to lower wall 56 to accommodate a preferred embodiment of slackless adjustment apparatus 12. The slope of the illustrated taper implies a more narrow section of wall 60 at upper wall 52, and a wider section of wall 60 at lower wall 56. The particular style of slackless adjustment apparatus is not a limitation to the present invention.

An enlarged illustration of cast front-stop 84 is provided in FIGS. 5, 5A and 6, and it is appreciated that casting 86 is a similar structure, thus only front-stop casting 84 will be described. As noted in FIGS. 5, 5A and 6, casting 84 has stop surface 80 to provide a draft stop surface for pocket casting surface 72. A second stop surface 150 is provided as a buff stop surface for pocket-casting surface 152. Front-stop surface 80 and front-stop second surface 150 are separated by valley 154 in FIGS. 1 and 5A for receipt of pocket-casting front plate 76, which allows sliding contact of front plate 76 between first and second front-stop surfaces 80 and 150. Valley 154 is within or coextensive with pocket-casting chamber 37.

Slackfree or slackless coupler apparatus 12 has follower 92 and wedge 100, and it is operable to minimize the free slack of coupler 16 along longitudinal axis 18. In the illustrated embodiment of FIGS. 1 and 2, follower 92 has a downwardly tapered rear surface 94 and a concave, spherically curved, forward surface 96 for mating engagement with convex, spherical butt surface 98 of coupler rear end 30. Tapered surface 94 provides a wider cross-section at its lower portion than at the upper cross-section of follower 92 in the figures.

Wedge 100 of slackless apparatus 12 has a generally wedge-shaped, vertical cross-section with a wider upper, cross-sectional area than its lower cross-sectional area. Wedge 100 is interposed between follower 92 and rear wall 60 in chamber 37. Tapered forward face 102 of wedge 100 slidingly contacts rear face 94 of follower 92. Rear face 93 of wedge 100 slidingly contact forward face 90 of pocket-casting rear wall 60. In this configuration, wedge 100 is operable to move downward, as the coupler components wear, to accommodate any change in their dimensions and maintain the relative slackless condition, that is minimal longitudinal motion, of coupler assembly 10. This general structure and operation of slackless apparatus 12 is a rather generic description of a slackless apparatus. However, the specific arrangement or component slackless structure is not a limitation to the operation and assembly of the present invention.

In FIG. 2, draft/buff gear apparatus 14 and pocket-casting 36 are slidably positioned in center-sill passage 26. Front gear plate 110 of buff/draft gear apparatus 14 with generally central throughport 112 is slidably positioned in center-sill passage 26 contacting rear draft-stop faces 165 of front stops 84 and 86. Rear gear plate 114 with central throughport 116 is positioned and secured in center-sill passage 26 contacting rear positive stop 115, which front and rear gear plates 110 and 114, and center sill 24 provide draft gear enclosure 118 within chamber 26. Rear positive stop 115 is secured to center sill sidewalls 38 and 40 by means known in the art, and includes a generally centrally positioned throughbore 117 in FIG. 1.

Figure 9:
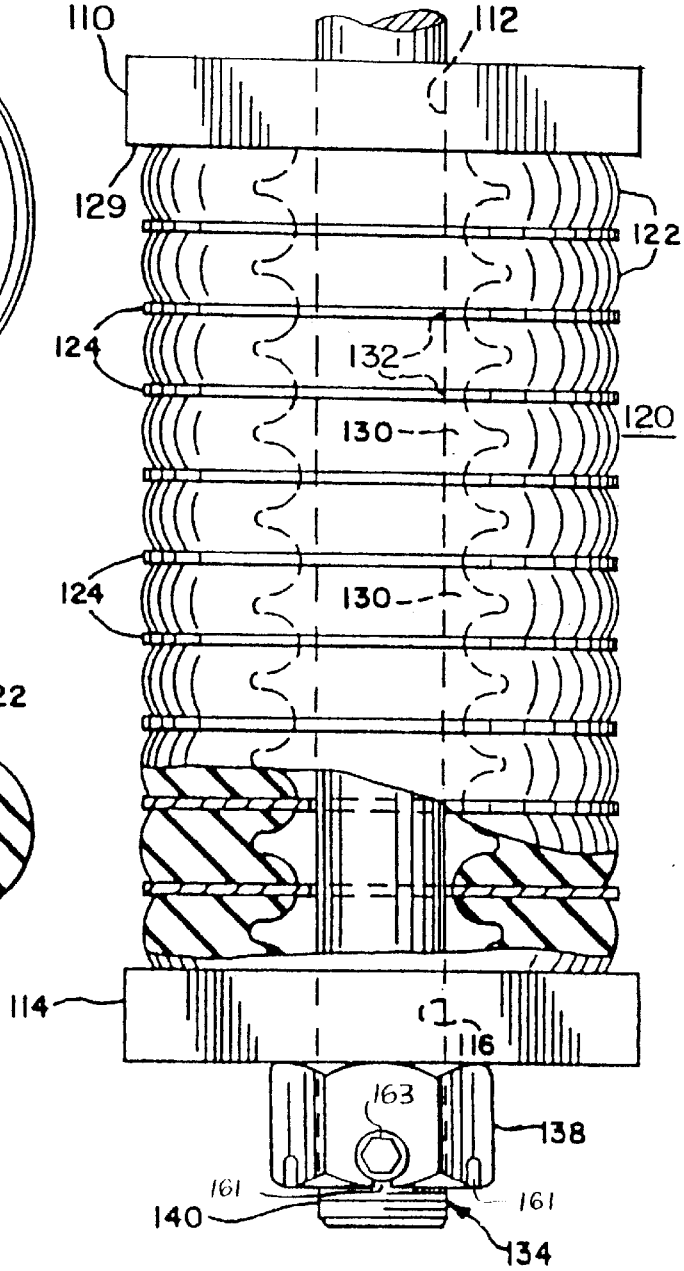

Buff/draft apparatus 14 has draft gear 120 in FIGS. 1, 2 and 9, which draft-gear assembly 120 is composed of a plurality of elastomeric segments 122 each separated from an adjacent segment 122 by a divider plate 124. Draft gear 120 is positioned and operable in draft-gear enclosure 118 to provide a shock-absorbing or dynamically loaded arrangement of coupler assembly 10.

Each of elastomeric segments 122 and dividers 124 has a generally centrally positioned passage or aperture 130, 132, respectively, to receive connecting rod or element 134 extending through pocket-casting port 62, forward plate passage 112, rear plate passage 116 as well as the noted passages 130, 132. Rod 134 is illustrated as a bolt with its head 142 nested in a counterbore 61 at the forward surface 90 of pocket-casting rear wall 60. Bolt 134 is secured against the rear wall of rear gear plate 114 by nut 138 on threaded bolt end 140, which nut 138 is sized to pass through throughbore 117 of rear positive stop 115.

Bolt end 140 of rod 134 has a passage 159 in FIG. 2, and nut 138 has at least one trough 161 in its top end. A retaining screw 163 with retaining nut 165 extends through the bolt-end passage 159 and is situated in trough 161 to secure nut 138 on bolt end 140. Alternative securing means, such as a cotter pin, may also be utilized to secure nut 138 on bolt end 140.

Figure 8:
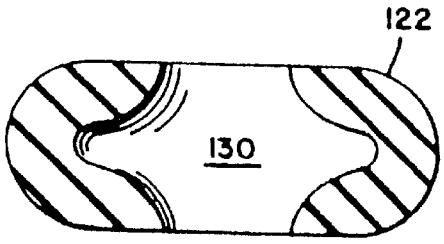
FIG. 8 is an elevational cross-section of the elastomer body in FIG. 7, which has been compressed under a load; and, FIG. 9 is a plan view in partial cross-section of a plurality of elastomer members axially aligned for a chamber.

Nesting of bolt head 142 in counterbore 61 provides a smooth surface along front face 90 of pocket casting rear wall 60, which smooth surface allows freedom of movement for wedge 100 of slackless apparatus 12. The effect of a compressive load on elastomeric elements 122 is illustrated in FIGS. 8 and 9, where the deformation of passages 130 is demonstrated. The structure of FIG. 9 is a known embodiment of a draft gear assembly for absorbing buff forces in a coupler assembly, such as coupler assembly 10.

Draft gear assembly 14 and slackfree apparatus 12 are both operable in standard operating modes as individual components. In these modes, slackfree apparatus 12 is operable to continuously adjust coupler 10 and arm 22 to maintain a cushioning slack or no slack condition. As noted above, the term slackless or slackfree is indicative of a very limited amount of free play between the several components of a railway car coupling connection. At assembly of coupler 10, elastomeric elements 122 are slightly compressed to provide a dynamic load to coupler assembly 10 at the reference position, which dynamic load allows the draft gear 14 to assist in absorbing the shock load at initiation of railcar motion in the draft direction. There is a small separation distance, 'x', which is illustrated in FIG. 1, between front-stop surface 82 and,pocket-casting tongue front surface 74, and a similar separation is noted at opposed front-stop 84. This separation accounts for the cushioned draft slack provided by the precompressed draft/buff gear 120. In the illustrated reference position of the coupler components noted in FIGS. 1 and 2, connecting pin 64 is provided in contact with the walls of passages 54 and 58, which is the usual position of a coupler assembly during draft direction of travel of a railcar.

In the buff direction, that is coupler movement to the left in FIGS. 1 and 2, coupler assembly 10 moves pocket-casting 36 with slackless apparatus 12, as well as front gear plate to compress elastomeric elements 122 for absorption of the buff forces from the railcar or locomotive, especially those forces experienced during humping of railcars in a classification yard. The limit of travel of draft gear 12 and pocket casting 36 in the buff direction is fixed by the separation distance 'y' between second stop surface 150 and pocket-casting stop surface 152. This also limits the energy absorbed by draft gear 14, as no further compression of elastomeric elements 122 may occur.

The limits of travel of the slackfree/draft-gear structure in coupler assembly 10 are thus fixed in the draft direction by separation distance 'x', which couples pocket casting 36 with stop castings 84, 86 and thereby connects center sill 24 with coupler assembly 10 and the coupled railcars. All the mechanical forces are, therefore, almost immediately transferred to front-stop castings 84, 86 and, thus, center sill 24, as separation distance 'x' is about three-quarter (0.75) inch, which is generally related to the "slackless" condition in railway car couplers. The draft gear apparatus is also operable to absorb the shock load associated with railcar travel in the buff direction. In the illustration of FIGS. 1 and 2, the separation distance 'y' is about two and three-eights (2.375) inches. The travel distance of pocket casting 36 in the buff direction is limited by front-stop castings 84, 86, as casting 36 slides parallel to the walls of front-stop castings 84 and 86 during inboard travel in center-sill cavity 26.

While only specific embodiments of the invention have been described and shown, it is apparent that various alterations and modifications can be made therein. It is, therefore, the intention in therefore the appended claims to cover all such modifications and alterations as may fall within the true scope and spirit of the invention.

We claim:

1. An assembly to couple and cushion the dynamic loading in a slackless connector for a railway car in the buff and draft directions of travel, said railway cars having a railway-car center sill with a center-sill pocket, said center sill having a longitudinal axis, a front end and a rear end, said front end being open, a coupler mechanism with a coupler shank, said shank having a shank front end and a shank butt end, a slackless coupler mechanism, said shank butt end contacting said slackless coupler mechanism, a pocket casting having an upper wall, a lower wall, a forward end, a rearward end, a rear wall at said rearward end, a chamber, two front-plates each having a generally transverse front contact surface and a generally transverse rear contact surface, and an opening at said forward end communicating between said chamber and said center-sill open front end, said pocket-casting upper wall defining a first pin port and said lower wall defining a second pin port, said first and second pin ports approximately aligned and about transverse to said longitudinal axis, said pocket casting positioned in said center-sill pocket with said pocket-casting opening communicating between said pocket-casting chamber and said center-sill open front end, said slackless coupler mechanism and said shank rear end positioned in said pocket-casting chamber;

a draft gear subassembly positioned in said center-sill pocket between said center-sill rear end and said pocket-casting rear wall, means for connecting said draft gear subassembly and said pocket-casting;

two front-stops, each front-stop having a generally transverse front engagement surface and a generally transverse rear engagement surface, each said front-stop secured to said center sill in said center-sill pocket, each of said pocket-casting front-plate front contact surfaces contacting one of said front-stop front engagement surfaces and each of said pocket-casting front-plate rear contact surfaces contacting one of said front-stop rear engagement surfaces during buff or draft movement to limit the buff and draft movement of said pocket casting and said coupler shank in said center-sill pocket during said buff and draft movements of said railway car and coupler assembly.

2. An assembly to couple and cushion the dynamic loading in a slackless connector for a railway car in the buff and draft directions of travel as claimed in claim 1 wherein said draft gear subassembly biases said pocket casting to provide said pocket-casting front plate in proximity to said front-stop front engagement surface and displaced from said front-stop front engagement surface by a first gap distance.

3. An assembly to couple and cushion the dynamic loading in a slackless connector for a railway car in the buff and draft directions of travel as claimed in claim 2 wherein said first gap distance is about three-quarter inch.

4. An assembly to couple and cushion the dynamic loading in a slackless connector for a railway car in the buff and draft directions of travel as claimed in claim 2 wherein said pocket-casting front plate at said reference position is displaced from said front-stop rear engagement surface by a second gap distance.

5. An assembly to couple and cushion the dynamic loading in a slackless connector for a railway car in the buff and draft directions of travel as claimed in claim 4 wherein said second gap distance is about two and three-eighths inches.

6. An assembly to couple and cushion the dynamic loading in a slackless connector for a railway car in the buff and draft directions of travel as claimed in claim 1 wherein said center sill has at least one sidewall, said sidewall defining a mounting port, each said front-stop having a mounting lug, said mounting lug positioned in said mounting port to secure said front-stop in said center sill pocket.

7. An assembly to couple and cushion the dynamic loading in a slackless connector for a railway car in the buff and draft directions of travel, said railway cars having a railway-car center sill with a center-sill pocket, said center-sill having a longitudinal axis, a front end and a rear end, said pocket front end being open, a rear positive stop secured in said center-sill pocket at said rear end, a coupler mechanism having a coupler shank and a knuckle for connecting adjacent railway cars, said shank having a first end and a second end, said knuckle mounted at one of said shank first and second ends, the other of said shank first and second ends having an arced surface and positioned in said center-sill pocket, said cushioning and coupling assembly comprising:

a pocket casting (36) having an upper wall, a lower wall, a forward end, a rearward end, a rear wall, a chamber, at least one front-plate (76,78) and an opening at one of said forward and rearward ends, which opening communicates between said pocket-casting chamber and said center-sill front end, said pocket-casting rear wall having a front face and a rearward face and an aperture through said wall between said front face and rear face, said pocket-casting upper wall defining a first port and said lower wall defining a second port, said first and second ports substantially aligned and about transverse to said longitudinal axis;

a coupling pin;

said coupler shank defining a through-passage, said through-passage alignable with said pocket-casting first and second ports, said coupling pin mated with said through-passage, said first port and said second port to connect said coupler shank and said pocket casting;

a slackless coupler mechanism positioned in said enclosure between said pocket-casting rear wall and said coupler-arm other end, said slackless mechanism having a follower and a wedge mounted in said pocket-casting chamber, said follower having a rear face and a front face with a contoured surface for contacting said coupler-shank arced surface in said pocket-casting enclosure (37), said wedge having a forward surface to contact said follower rear face and a rearward surface to contact said rear-wall forward face, said wedge operable to maintain said coupler mechanism in said slackless condition;

a rear gear plate having a through-bore, said rear gear plate positioned in said center-sill pocket in proximity to said rear positive stop;

a front gear plate having a passage, said front gear-plate positioned in said center-sill pocket between said pocket-casting rear wall and said rear gear-plate;

said rear gear-plate(114), front gear-plate (110) and said center sill cooperating to define an enclosure within said center-sill pocket;

a draft-gear subassembly positioned and operable in said center-sill enclosure between said front gear-plate and said rear gear-plate;

means for connecting said pocket casting and draft-gear subassembly to said rear positive stop, said means for connecting said slack-free coupler and draft gear subassembly providing a compressive force preload on said coupler and coupler-arm in both the buff and draft directions of railway car travel;

at least one front-stop (84, 86) having a front engagement surface and a rear engagement surface, said front-stop positioned in said center-sill pocket, secured to said center sill such that said pocket-casting front plate (76, 78) engages said front-stop front engagement surface and said front-stop rear engagement surface under buff and draft loads to limit buff and draft sliding movement of said pocket casting and coupler shank in said center-sill pocket.

8. A pocket casting and front-stop arrangement for a slackless coupler of a railcar, said coupler having a shank with a first end and a second end, said railcar having a longitudinal axis, a center sill with an open forward end, a rearward end having a positive stop and a pocket to receive one of said shank first and second ends, said shank having a passage at said one end, means for connecting, a slackless mechanism, a draft gear subassembly positioned in said pocket, said pocket casting comprising:

an upper wall, a lower wall, a forward end, a rearward end, a rear wall, said upper wall, rear wall and lower wall cooperating to define a chamber in said pocket casting, said pocket-casting positioned and movable in said center-sill pocket;

said pocket-casting chamber open at said forward end to said center sill open end, and said pocket casting including at least one front-plate (76,78) having a front face and a rearward face, said pocket-casting upper wall defining a first port and said lower wall defining a second port, said first and second ports substantially aligned and about transverse to said longitudinal axis;

said slackless mechanism mounted in said pocket-casting chamber between said rear wall and said one end of said shank;

said connecting means extending through said first port, said shank passage and said second port to connect said pocket-casting and said coupler;

said draft gear subassembly positioned and operable in said center-sill pocket between said rear wall and said rear positive-stop;

a front-stop;

means for securing;

said front-stop having a front engagement surface and a rear engagement surface mounted in said center-sill pocket and anchored by said securing means;

said front-stop front engagement surface contacting said pocket casting front plate front face and said front-stop rear engagement surface contacting said pocket casting front plate rearward face under buff and draft loads to limit the longitudinal movement of said shank and pocket casting in the buff and draft directions.

9. A pocket casting and front-stop arrangement or a slackless coupler of a railcar as claimed in claim 8 further comprising means for connecting said pocket casting, said draft gear subassembly and said rear positive stop.

* * * * *